US005453774A

United States Patent [19]

Henson

[11] Patent Number: 5,453,774

[45] Date of Patent: Sep. 26, 1995

[54] THERMAL PRINTING APPARATUS

[75] Inventor: Walter H. Henson, Hornchurch, United Kingdom

[73] Assignee: Neopost Limited, Essex, United Kingdom

[21] Appl. No.: 169,363

[22] Filed: Dec. 20, 1993

[30] Foreign Application Priority Data

Dec. 23, 1992 [GB] United Kingdom ..... 9226781

[51] Int. Cl.[6] ..... B41J 2/32

[52] U.S. Cl. ..... 347/171; 347/218; 347/220

[58] Field of Search ..... 347/171, 218, 347/220; 346/134; 400/658, 659, 120.01; 101/37, 41, 42, 43, 44

[56] References Cited

U.S. PATENT DOCUMENTS 3,735,697 5/1973 Provan .

4,938,129 7/1990 Miciukiewicz et al. ..... 101/76

FOREIGN PATENT DOCUMENTS 0195981 10/1986 European Pat. Off. .

4022883 2/1991 Germany .

*Primary Examiner*—Huan H. Tran

*Attorney, Agent, or Firm*—Shoemaker and Mattare, Ltd.

[57] ABSTRACT

Thermal printing apparatus has an impression roller mounted in opposition to a thermal print head, the mounting for the impression roller permitting movement of the impression roller toward and away from the thermal print head and the impression roller having a part cylindrical surface and a planar surface. Prior to a printing operation the roller is positioned with its planar surface co-planar with a feed bed. An actuator projects from the planar surface so as to be engaged by a leading edge of a print receiving medium entered between the impression roller and the print head. Engagement of the actuator rotates a drive gear for the impression roller into driving engagement with drive means.

9 Claims, 2 Drawing Sheets

THERMAL PRINTING APPARATUS

BACKGROUND OF THE INVENTION

This invention relates to thermal printing apparatus and in particular to the construction of means to feed items past a thermal print head for printing impressions on the items. The feeding means is particularly intended for use in franking machines for feeding mail items past a thermal print head.

Recently franking machines have been proposed in which thermal print heads are utilised to print franking impressions on mail items. The thermal print heads include a plurality of thermal printing elements disposed in a row extending transversely of a direction of feed of the mail items. A thermal transfer ink ribbon comprising a backing film carrying a transfer layer of ink is fed between the thermal elements and the mail items with the backing film in contact with the thermal elements and the ink layer in contact with the surface of the mail items. Selective heating of the thermal elements as the mail item is fed past the elements is effective to transfer ink selectively to the mail item and to build up row by row a franking impression on the mail item. The thermal printing requires that the ink transfer ribbon is maintained in heat transfer relationship with the thermal elements and that the front surface of the mail item which is to receive the impression is maintained in ink transfer engagement with the ink layer. Accordingly in known constructions of franking machine utilising a thermal print head and a thermal transfer ink ribbon a roller is disposed opposite the thermal elements and applies pressure to a rear surface of the mail item to ensure that the required heat transfer relationship between the ribbon the thermal elements and the required ink transfer engagement between the mail item and the ink layer is maintained during printing. The roller is constructed to be resiliently deformable or is mounted in a pivoted cradle which permits the roller to move toward and away from the thermal elements so as to accommodate mail items of different thicknesses.

SUMMARY OF THE INVENTION

According to the invention thermal printing apparatus includes a chassis; a feed bed for items on said chassis; a thermal print head including thermal printing elements and rigidly mounted on said chassis in spaced relation to said feed bed; an impression roller rotatably mounted in opposition to said thermal printing elements, said impression roller being movable toward and away from said printing elements; said impression roller being of cylindrical form with a part cylindrical surface and a planar surface portion; said planar surface being substantially coplanar with said feed bed prior to a printing operation to enable a leading edge of a print receiving medium to enter between said planar surface portion and said print head; and drive means operable to rotate said impression roller to bring said cylindrical surface into frictional engagement with said print receiving medium and to thereby feed said print receiving medium past said thermal printing elements of said thermal print head in printing relationship with said thermal printing elements.

BRIEF DESCRIPTION OF THE DRAWING

An embodiment of the invention will be described by way of example with reference to the drawings in which.

DESCRIPTION OF THE PREFERRED EMBODIMENT

Figure 1:
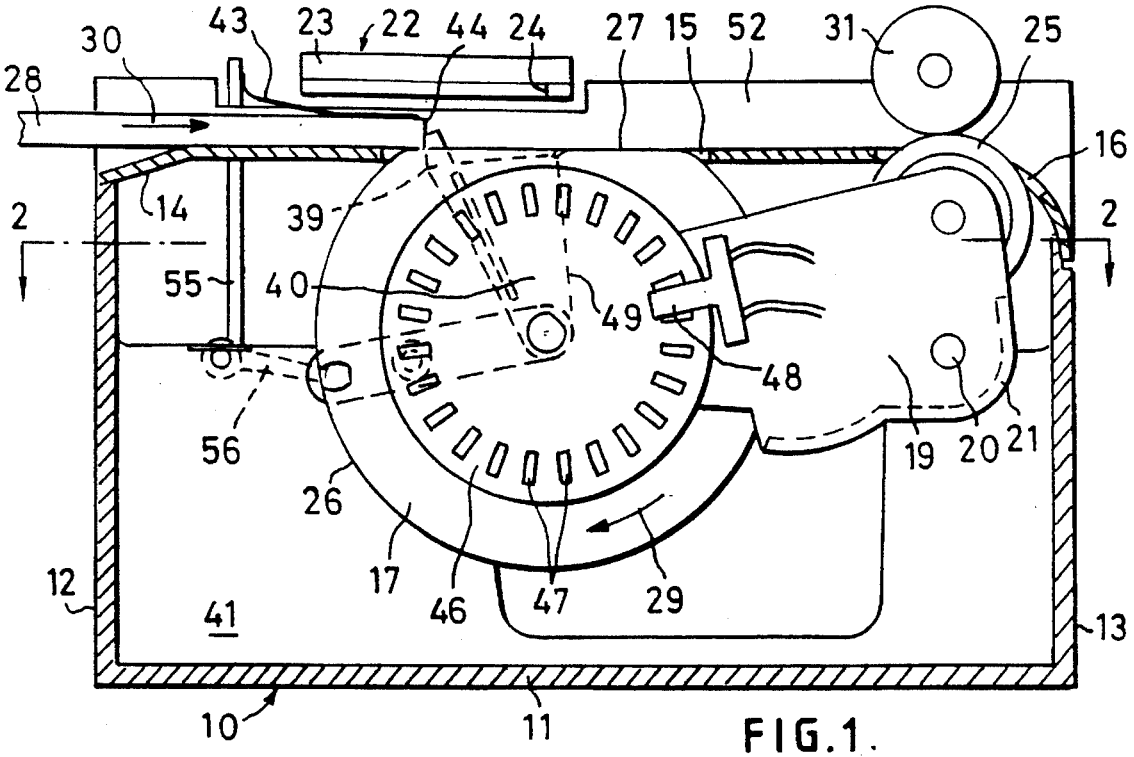
FIG. 1 is a sectional front view of a mechanism for feeding mail items.
Figure 2:
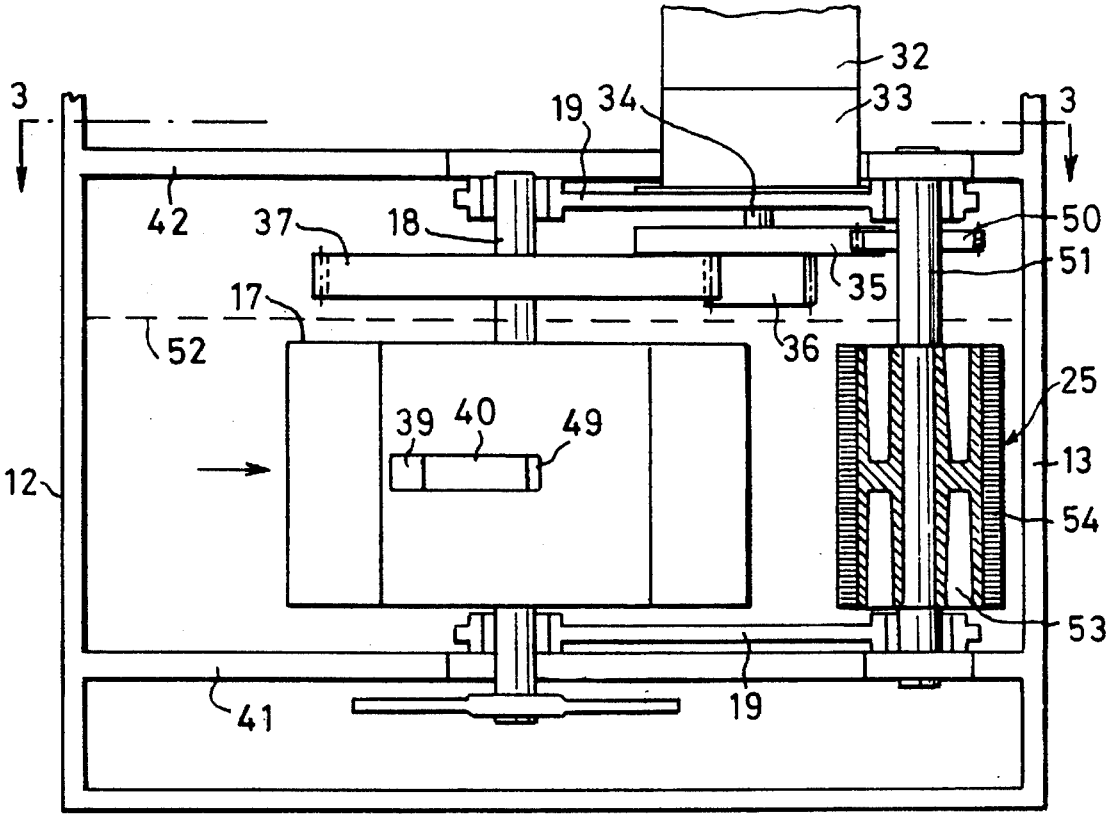
FIG. 2 is a sectional plan view on line 2—2 of FIG. 1 of the feeding mechanism.
Figure 3:
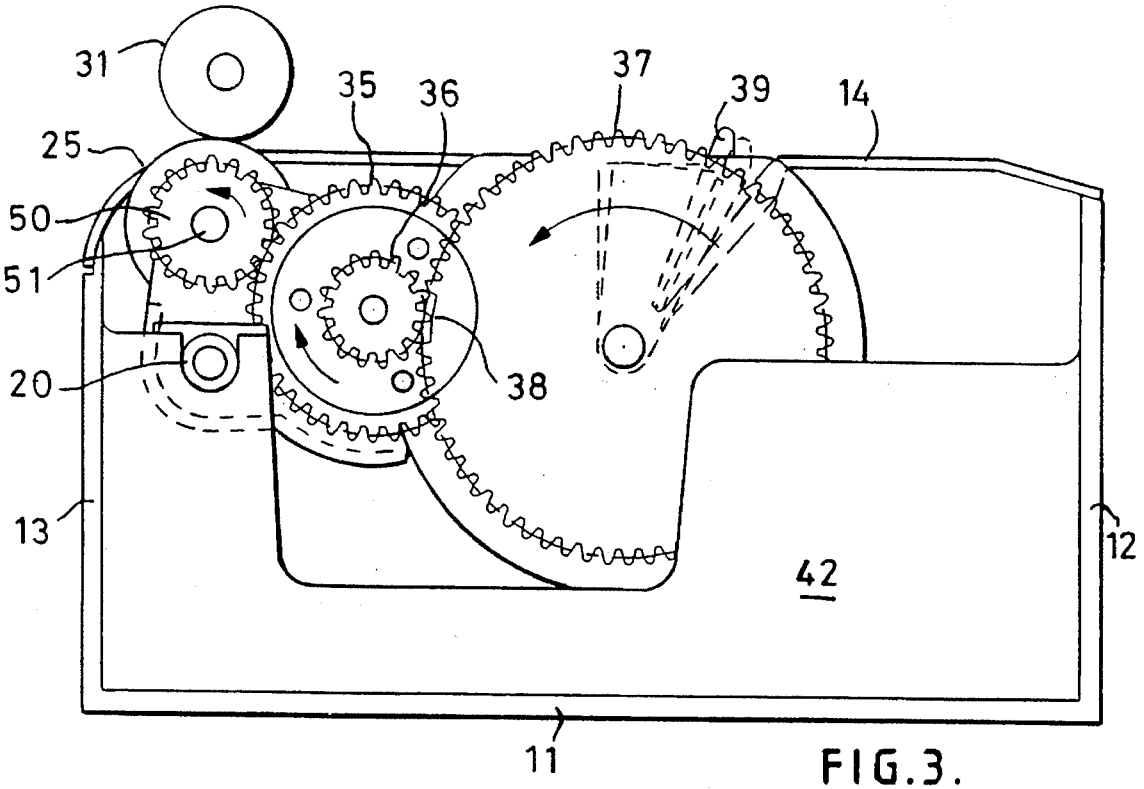
FIG. 3 is a rear view on the line 3—3 of FIG. 2.

Referring first to FIGS. 1, 2 and 3 of the drawings, a printing device of a franking machine includes a main chassis 10 having a base 11 and side walls 12, 13. A feed bed 14 for mail items extends across the top of the chassis from the upper edge of side wall 12 to the upper edge of side wall 13. A rectangular aperture 15 is provided in a central part of the feed fed and a further aperture 16 is provided in the feed bed adjacent the side wall 13. A guide 52 for the mail items extends along a rear edge of the feed bed 14.

An impression roller 17 is mounted on a shaft 18 and is rotatable relative to the shaft. The shaft 18 is rotatably supported by side arms 19 of a cradle pivoted on partition walls 41, 42 of the main chassis 10 by pivotal bearings 20. The side arms of the cradle are rigidly joined by a cross member 21 indicated in FIG. 1 by broken line. The impression roller 17 is located so as to extend through the aperture 15 in the feed bed 14. A thermal print head 22, comprising a substrate 23 carrying a plurality of thermal print elements 24 extending in a line, is disposed above (as shown in FIG. 1) and spaced from the feed bed 14. The thermal print head is so positioned that the line of thermal print elements 24 extends transversely of the feed bed parallel to the rotational axis of the impression roller and is aligned with the axis of the impression roller. An ejection roller 25 is mounted on a shaft 51 rotatably supported by the side arms 19 of the cradle adjacent the side wall 13 of the chassis. Spring means (not shown) acting on the cradle are provided to urge the cradle to pivot in a clockwise direction and thereby urge the impression roller toward the print head. The impression roller 17 has a part cylindrical surface 26 and a planar surface 27 and hence has an approximately 'D' shaped section. Initially, prior to carrying out a franking printing operation, the impression roller has a rotational orientation such that the planar surface 27 thereof lies parallel to the feed bed 14 and stops (not shown) limit the clockwise pivotal movement of the cradle such that the planar surface 27 of the impression roller lies flush with the surface of the feed bed. When a mail item 28 is placed on the feed bed with an upper edge of the mail item in engagement with the guide 52 and a leading end 44 of the item located adjacent the impression roller, drive means (to be described hereinafter) drives the impression roller to rotate in a clockwise direction indicated by arrow 29. Springs 43 press the mail item against the impression roller 17 so that friction between the surface of the impression roller and the mail item is effective to feed the mail item, in the direction of arrow 30, past the thermal printing elements towards the ejection roller 25 as shown in FIG. 3. A thermal transfer ink ribbon, which for clarity is not shown in the drawings, extends along a path between mail item and the print elements of the print head. During feeding of the mail item by the impression roller, the upper surface of the mail item engages an ink layer on the thermal transfer ink ribbon and draws the ink ribbon along with the mail item. Due to the thickness of the mail item, the mail item displaces the impression roller away from the print head, and the cradle away from its limit position, against the action of the springs acting on the cradle. Thus the springs urge the impression roller to maintain frictional engagement with the mail item and maintain the mail item in engagement with the ink layer and the ribbon in engagement with the print elements. During feeding of the mail item by rotation of the impression roller the thermal printing elements are selectively and repeatedly heated to transfer ink from the ink layer of the thermal transfer ink ribbon to print an impression in a column by column manner on the mail item. The selective and repeated operation of the thermal print elements of the thermal print head is well known and does not form part of the inventive subject matter of the present invention and therefore is not described in detail herein. After passing the print head, the leading end of the mail item is received in a nip between the ejection roller 25 and a co-operating idler roller 31. As will be described hereinafter, the ejection roller is driven by the drive means for the impression roller and feeds and then ejects the mail item from the feed bed of the franking machine.

Figure 4:
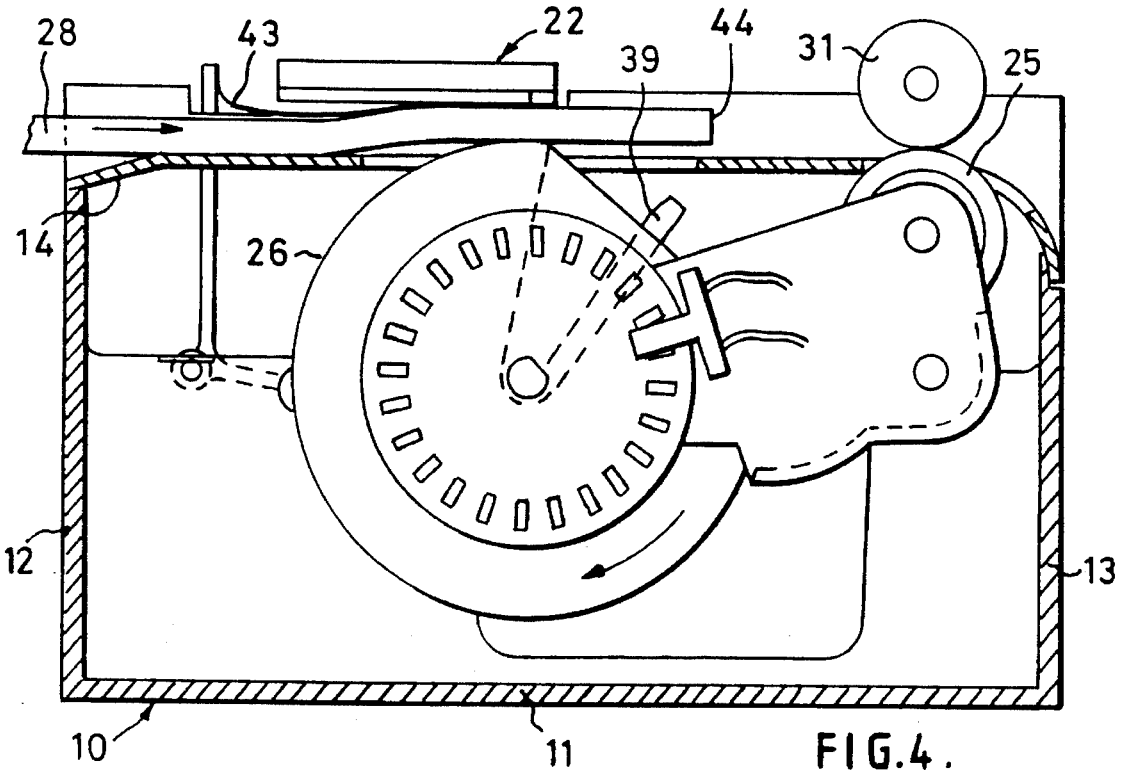
FIG. 4 is a view similar to FIG. 1 showing an item being fed.

Referring to FIGS. 2 and 4 the drive means for rotating the impression roller and the ejection roller to feed and eject the mail item will now be described. A drive motor 32 and gear box 33 is mounted on side arm 19 of the cradle. The motor drives, by means of the gear box, an output shaft 34. A first gear wheel 35 is secured to the output shaft and drives through a one-way clutch arrangement a second gear wheel 36. The second gear wheel 36 meshes with a third gear wheel 37 secured to the shaft 18 of the impression roller 17. The third gear wheel 37 has a portion 38 devoid of gear teeth and prior to initiation of drive to the impression roller, the portion 38 is aligned with the second gear wheel 36. Accordingly, with the portion 38 aligned with the second gear wheel 36, the drive motor is unable to transmit drive via the second gear wheel to the third gear wheel to drive the impression roller shaft. An actuator 39 is secured to the shaft 18 and extends radially from the shaft through a slot 40 in the impression roller so that a free end of the actuator projects from the planar surface 27 of the impression roller and hence in the initial position of the impression roller the actuator projects above the surface of the feed bed 14 as shown in FIG. 1. The radial length of the actuator is approximately equal to the radius of the cylindrical surface 26. The slot has a greater angular extent than the actuator so that the actuator has limited freedom of angular movement within the slot. Initially, prior to operation of the drive motor, the actuator lies against a trailing end 45 of the slot and is urged into this position by resilient means (not shown). When a mail item is placed on the feed bed and moved along the bed, the leading end 44 of the mail item engages the actuator and pivots the actuator, relative to the impression roller, together with the impression roller shaft 18 about the axis of the shaft 18. This pivoting of the shaft 18 causes a similar angular rotation of the third gear wheel 37 such as to bring the teeth of the third gear wheel into meshing engagement with the second gear wheel 36. The one way clutch between the first and second gear wheels permits rotation of the second gear wheel 36 as the teeth of the third gear wheel 37 are brought into mesh with the second gear wheel 36.

A tachometer sensor disc 46 is secured to the shaft 18 and slots 47 on the disc are sensed by a sensing device 48. Pivoting of the shaft 18 resulting from engagement of the leading end of the mail item with the actuator causes rotation of the sensor disc 46 and hence causes the slots 47 to move relative to the sensing device 48. As a result the sensing device 48 outputs a signal to initiate energisation of the drive motor 32. Accordingly the second gear wheel 36, which is now meshed with the third gear wheel 37, drives the third gear wheel 37 and the shaft 18. The actuator 39 is rotated by the shaft 18 in the direction of arrow 29 and upon engagement of the actuator with a leading end 49 of the slot 40, drive is imparted by the actuator to the impression roller. When the shaft 18 has been rotated through one revolution the portion 38 of the third gear wheel 37 is once again aligned with the second gear 36 so that drive to the shaft 18 is terminated. Detent means (not shown) is provided to maintain the impression roller in the initial position with the planar face aligned with the feed bed and to maintain the portion 38 devoid of teeth of the third gear wheel 37 aligned with the second gear wheel 36. The actuator is formed such that it is able to deflect to a position flush with the feed bed until the mail item has been fed to an extent sufficient for the trailing end of the mail item to pass clear of the actuator. The actuator then resumes its initial position to await engagement by the leading edge of the next mail item.

A fourth gear wheel 50, secured to the shaft 51 of the ejection roller 25, meshes with the first gear wheel 35 and hence when the drive motor is energised the ejection roller is driven. The energisation of the drive motor is continued, after termination of the drive to the impression roller shaft 18 until the mail item has been ejected from the nip between the ejection roller and the idler roller.

The ejection roller 25 comprises a substantially rigid cylindrical body 53 and a resiliently deformable outer portion 54 to accommodate mail items of different thicknesses between the ejection roller 25 and the idler roller 31.

The springs 43 are mounted on a support member 55 pivotally mounted on the chassis 10. The support member 55 is coupled by means of a link arm 56 to the cradle on which the impression roller is mounted. The link arm 56 is effective to pivot the support member so as to raise the springs further away from the feed bed when the cradle is displaced to a relatively great extent due to thick mail items being fed.

While the feed mechanism for items to be printed by the thermal print head has been described in relation to its use in a franking machine, it will be appreciated that the mechanism may be utilised for feeding items other than mail items in apparatus other than franking machines. Accordingly references to mail items and franking machines are used as examples only and are not to be understood as limiting the invention.

I claim:

1. Thermal printing apparatus including a chassis; a feed bed for items on said chassis; a thermal print head including thermal printing elements and rigidly mounted on said chassis in spaced relation to said feed bed; an impression roller rotatably mounted in opposition to said thermal printing elements, said impression roller being movable toward and away from said printing elements; said impression roller being of cylindrical form with a part cylindrical surface and a planar surface portion; said planar surface being substantially coplanar with said feed bed prior to a printing operation to enable a leading edge of a print receiving medium to enter between said planar surface portion and said print head; and drive means operable to rotate said impression roller to bring said cylindrical surface into frictional engagement with said print receiving medium and to thereby feed said print receiving medium past said thermal printing elements of said thermal print head in printing relationship with said thermal printing elements.

2. Thermal printing apparatus as claimed in claim 1 wherein said drive means includes a first gear wheel coupled to a drive motor and a second gear wheel coupled to said impression roller; said second gear wheel including gear teeth disposed around the periphery thereof and having a peripheral portion devoid of teeth, said second gear wheel being orientated prior to a printing operation with said peripheral portion aligned with said first gear wheel so that the first gear wheel is unable to transmit drive to the second gear wheel and including actuator means operative in response to the presence of the leading edge of the print receiving medium adjacent the impression roller to rotate the second gear wheel through an angle sufficient to bring said gear teeth into mesh with said first gear wheel to enable said first gear wheel to transmit drive via said second gear wheel to said impression roller.

3. Thermal printing apparatus as claimed in claim 2 wherein the impression roller is mounted on and rotatable relative to a shaft; the second gear wheel being secured to said shaft and wherein said actuator means includes a member secured to said shaft and extending radially from said shaft to extend beyond the planar surface portion of the impression roller; said member being engageable by the leading edge of the print receiving medium to effect rotation of said member, said shaft and said second gear wheel and thereby to bring the second gear wheel into mesh with the first gear wheel; and abutment means on the impression roller engaged by said member to transmit drive from said member to said impression roller.

4. Thermal printing apparatus as claimed in claim 2 including a cradle and an ejection roller to eject the print receiving medium from the thermal printing apparatus; the ejection roller and the impression roller being carried by said cradle and said ejection roller being driven by a third gear wheel meshing with the first gear wheel.

5. Thermal printing apparatus as claimed in claim 4 including an idler roller forming with the ejection roller a nip to receive the print receiving medium

6. Thermal printing apparatus as claimed in claim 4 wherein the drive motor is carried by the cradle.

7. Thermal printing apparatus as claimed in claim 1 including a driven ejection roller to eject the print receiving medium from the thermal printing apparatus.

8. Thermal printing apparatus as claimed in claim 1 wherein the impression roller is carried in a cradle pivotable relative to the chassis.

9. Thermal printing apparatus as claimed in claim 8 including spring means acting on the cradle to urge the impression roller toward the thermal print head.

* * * * *